United States Patent [19]

Schluckebier et al.

[11] Patent Number: 4,815,388

[45] Date of Patent: Mar. 28, 1989

[54] SHOT CHARGE AND WAD STRUCTURE FOR A COMBAT SHOTGUN

[75] Inventors: David K. Schluckebier; Richard H. Olson, both of Florissant, Mo.

[73] Assignee: Olin Corporation, Stamford, Conn.

[21] Appl. No.: 159,809

[22] Filed: Feb. 24, 1988

Related U.S. Application Data

[63] Continuation-in-part of Ser. No. 928,764, Nov. 11, 1986, abandoned.

[51] Int. Cl.[4] ..... F42B 7/08

[52] U.S. Cl. ..... 102/449; 102/438; 102/532

[58] Field of Search ..... 102/438, 448–463, 102/522, 532

[56] References Cited

U.S. PATENT DOCUMENTS

| | | | |
|---|---|---|---|
| 3,208,382 | 9/1965 | Foote et al. | 102/453 |
| 3,264,996 | 8/1966 | Rimas | 102/457 |
| 3,279,375 | 10/1966 | Hester . | |
| 3,598,057 | 8/1971 | Potter | 102/506 |
| 3,599,568 | 8/1971 | Shellnutt et al. | 102/455 |
| 4,428,295 | 1/1984 | Urs | 102/448 |
| 4,434,718 | 3/1984 | Kopsch et al. | 102/522 |

FOREIGN PATENT DOCUMENTS 2149067 6/1985 United Kingdom .

*Primary Examiner*—Harold J. Tudor
*Attorney, Agent, or Firm*—Bruce E. Burdick

[57] ABSTRACT

A shot charge and wad structure includes a thick-walled plastic shot wad cup having integrally connected base and continuous sidewall portions which together define a shot pocket with an open end for receiving and supporting a charge of shot. The structure also includes a shot pellet charge in the shot pocket composed of tungsten and having a hardness generally at least equal to that of the gun barrel in which a shotshell containing the pellets is to be fired. An insert disk is disposed in the pocket below and in supporting relation to the charge of shot pellets in the pocket. The disk is composed of a material, such as aluminum, having a hardness sufficient to prevent any of the pellets in the charge thereof from embedding therein or in the base portion. Instead, the charge cleanly separates from the pocket of the cup upon firing of a shotshell containing the charge. The shot pocket can be either generally square or circular in cross-section. The insert disk has a square or circular configuration adapting it to fit into corresponding square or circular pocket of the shot wad and rest on an interior surface of the base portion thereof.

5 Claims, 1 Drawing Sheet

SHOT CHARGE AND WAD STRUCTURE FOR A COMBAT SHOTGUN

CROSS REFERENCE TO RELATED APPLICATION

This application is a continuation-in-part of my prior copending application Ser. No. 06/928,764, filed Nov. 11, 1986 of the same title, now abandoned.

BACKGROUND OF THE INVENTION

1. Field of the Invention

The present invention generally relates to shotshells and, more particularly, is concerned with a shot charge and wad structure for a military shotgun.

2. Description of the Prior Art

It is convention practice to provide plastic wad structures for use in shotshells to house the shot charge, obturate combustion gases, and cushion the shot charge when the loaded wad is fired from a shotgun and to place a metal disc in the base of such structures to prevent the non spherical projectiles from embedding in or perforating the wad upon setback. One wad structure representative of this practice is illustrated and described in U.S. Pat. No. 3,599,568 to R. J. Shellnut et al. which Patent issued Aug. 17, 1971 and is assigned to the assignee of the present invention. However, when spherical shot is used, such metal discs have not been heretofore used, but rather plastic wads such as in U.S. Pat. No. 3,208,382, Foote et al, issued Sept. 3, 1963. When a shotshell containing one of these structures is loaded in a shotgun and fired, a propellant disposed in the shell tube rearwardly of an obturating Portion of the wad structure is consumed and produces high pressure combustion gases. The pressurized gases act upon the obturating portion, causing it to expand outwardly into sealing relationship with the inner surface of the shell tube and wall of the gun barrel bore. Such sealing prevents gas blow-by and thus increases the chamber pressure generated by a given propellant charge. Since the column of shot pellets contained in a forward shot pocket portion of the wad structure initially resists accelerative forward movement, the "set back" forces are applied by the shot in a rearward direction to the central portion of the base of the wad structure. Then, as the wad structure and shot column are propelled out of the shell tube and start to accelerate through the gun barrel, the shot column pushes radially outward toward the wall of the barrel bore and against the sidewall of the shot pocket portion of the wad structure.

In military shotshell applications, it would be desirable to penetrate metal structures at extended ranges. However, conventional shot wad structures are incapable of withstanding the high level of compressive forces generated by the larger propellant charges and harder pellets needed to penetrate thicker structures. Typically, the pellets become embedded into the plastic base of the shot wad structure when the shotshell is launched upon firing the shotgun.

As a result, the use of flechettes (see the Shellnut et al. patent mentioned above) has been attempted with mixed results. The accuracy of flechettes has not yet been developed to the point of achieving satisfactory results. As a result, the prior combat shotshells all fail to achieve the desired objectives.

Consequently, a need exists to come up with a solution which will overcome the problems encountered with use of prior military shot loads launched at metal penetrating high pressures and velocities.

SUMMARY OF THE INVENTION

The present invention provides a shot charge and wad structure designed to satisfy the aforementioned needs. The wad structure of the invention includes a thick-walled plastic cup having internal walls defining a shot pocket with either a generally square or circular cross-sectional shape. The shot wad with circular shot pocket allows an axially shorter shot column and thus allows slightly more powder charge with higher velocity while the shot wad with square cross-section reduces the radially expansion forces on the column of the pellets and thus gives less tendency to rub through the cup sidewall. Also, the wad structure includes either a thin, generally square or circular, disk sized to fit into the square or circular pocket of the cup and seat on the base thereof. The insert disk is composed of a material, such as aluminum, which has sufficient hardness to support the hard shot charge so as to ensure that the charge does not embed in the disk nor the base of the wad cup but instead cleanly separates from the shot wad upon muzzle exit due to aerodynamic drag forces and density differential.

Accordingly, the present invention is directed to a shot wad structure for use in a combat shotgun shotshell and to such wad structure in combination with hard shot pellets having a hardness generally at least equal to that of the barrel of a gun in which the shotshell is to be fired. The shot charge and wad structure includes: (a) a 12 gauge plastic shot wad cup having a base portion having an axial thickness in the range of from about 0.50 cm. to about 1.00 cm. and a continuous sidewall portion having a thickness within the range of from about 0.08 cm. to about 0.20 cm. integrally connected to the base portion which together therewith defines a shot pocket open at one end for receiving and supporting a charge of shot pellets; (b) a charge of 6 to 12 tungsten pellets having a diameter within the range of from about 0.60 cm. to about 0.70 cm. contained in the shot pocket; and (c) an insert disk disposed in the shot pocket below the charge of shot pellets and having an axial thickness within the range of from about 0.10 cm. up to about 0.20 cm. and being composed of a material sufficiently hard to prevent any of the pellets in the charge thereof from embedding therein.

More particularly, the shot pocket is either generally square or circular in cross-section. Correspondingly, the insert disk has either a generally square or circular configuration adapting the disk to fit into the square or circular pocket of the shot wad and rest on an interior surface of the base portion thereof in supporting relation to the charge of shot pellets. Still further, the preferred material of the insert disk is an aluminum being sufficiently hard to support the hard shot charge so as to ensure that the charge does not embed in the disk or base portion of the wad cup but instead cleanly separates from the pocket of the cup upon firing of a shotshell containing the shot wad structure.

The tungsten shot pellets in the charge in the square shot pocket are stacked within the pocket of the shot wad cup in layers wherein the pellets in one layer are aligned with and overlie the pellets in the next lower layer. Alternatively, the shot pellets in the charge in the circular shot pocket are stacked such than certain ones of the pellets are disposed in generally nested relation with other of the pellets.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
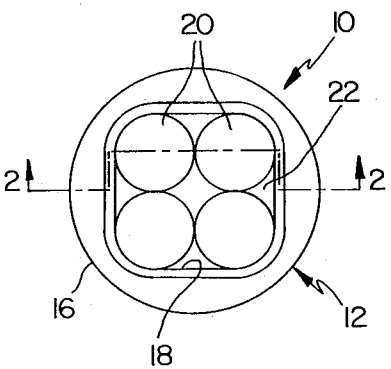
FIG. 1 is a top plan view of a first embodiment of the shot charge and wad structure of the present invention.
Figure 2:
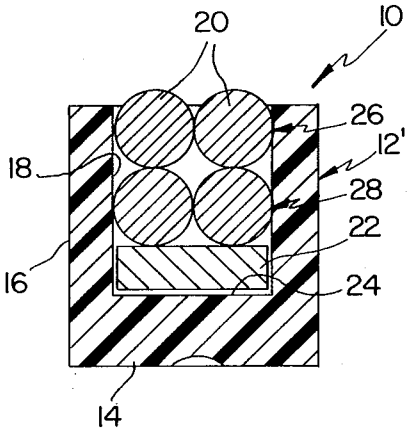
FIG. 2 is a longitudinal sectional view of the shot charge and wad structure taken along line 2—2 of FIG. 2.

Referring now to the drawings, and particularly to FIGS. 1 and 2, there is shown a first embodiment of the shot charge and wad structure constructed in accordance with the present invention. While useful with softer shot, such as shot made of lead, the structure 10 is particularly useful in a combat shotshell (not shown) in which the pellets are made from hard material such as steel, tungsten or any other suitable material having a hardness generally at least equal to that of the barrel of the gun in which the shotshell is to be fired and capable of penetrating such material in a target.

Basically, the shot charge and wad structure 10 includes a 12 gauge thick-walled plastic wad cup 12 formed in the shape of right cylinder and having a base portion 14 of thickness of from about 0.50 cm. to about 1.00 cm. and a continuous sidewall portion 16 of a thickness of from about 0.08 cm. to about 0.20 cm. integrally connected to the base portion which together therewith defines a shot pocket 18 open at one end. The structure 10 also includes a charge of 6 to 12 shot pellets of 0.60 cm. to 0.70 cm. diameter 20 contained in the shot pocket 18. The pellets 20 being composed of a material harder than steel, such as tungsten or the like. The base portion is preferably composed of a plastic material having a tensile strength within the range of from about 4,000 psi to about 8,500 psi as measured by ASTM Test Method D638 and having an impact notch strength within the range of from about 0.4 foot-pounds per inch up to 4.0 foot-pounds per inch as measured by ASTM Test Method D256A in the bottom quarter region of the wad where the base portion and wall portions join.

Finally, the structure 10 includes an insert disk 22 removably disposed in the shot cup pocket 18 below and in supporting relation to the charge of shot pellets 20 in the pocket 18. The disk 22 can be composed of any material, such as aluminum, having sufficient hardness to prevent any of the pellets in the charge thereof from embedding therein or in reaching and embedding in the base portion 14. Instead, the charge of shot pellets 20 cleanly separate from the pocket 18 of the cup 12 upon firing of a shotshell containing the charge. The insert disc preferably has a hardness of at least 70 when measured by the Rockwell B Hardness Test and an axial thickness within the range of from about 0.10 cm to about 0.20 cm.

Figure 3:
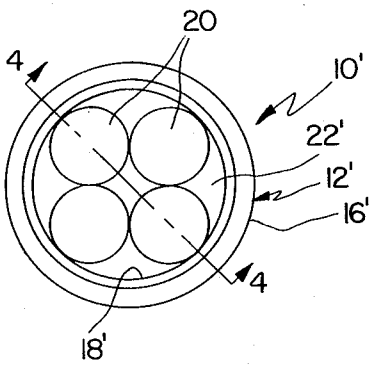
FIG. 3 is a top plan view of a second embodiment of the shot charge and wad structure of the present invention.
Figure 4:
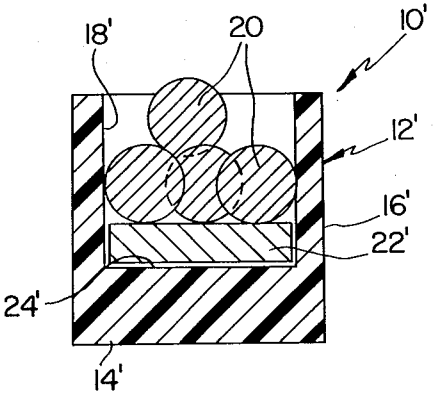
FIG. 4 is a longitudinal sectional view of the shot charge and wad structure taken along line 4—4 of FIG. 3

The shot pocket 20 defined in the wad cup 12 can be either generally square in cross-section, as in the case of the first embodiment in FIGS. 1 and 2, or circular in cross-section, as in the case of the second embodiment in FIGS. 3 and 4. The insert disk 22 has a generally square or circular configuration which matches that of the square or circular pocket 18 of the wad cup 12. Such respective configurations of the disk 22 adapts it to fit into the corresponding square or circular pocket 18 of the shot wad and rest on an interior surface 24 of the base portion 14.

The shot pellets 20 in the wad cup 12 with the square pocket 18 are stacked differently than the shot pellets 20 in the wad cup 12' with the circular pocket 18'. In the square pocket 18, the shot pellets 20 are stacked therein on the insert disk 22 in layers wherein the pellets in one layer 26 are aligned with and overlie the pellets 20 in the next lower layer 28. On the other hand, in the circular pocket 18', the pellets are disposed in generally nested relation with each other.

EXAMPLE 12 gauge shot wad cups 12 and 12' were injection molded from high density polyethylene (HDPE), with insert disks 22 of aluminum 7075-T6. The cups were loaded with 8 spherical #2 Buck (equivalent) tungsten pellets and were loaded into 3" long 12 gauge shells and fired. This testing demonstrated that pellets from shotshells containing shot wads with circular pockets were more accurate (experienced less down range dispersion) than those from square pockets. Specifically, on the one hand, the pattern percentage at fifty meters for pellets fired from circular pockets was 95% of the pellets striking the target within a circle radius of twenty inches and 100% of the pellets striking the target with a circle radius of thirty inches. On the other hand, the pattern percentage for pellets fired from square pockets at fifty meters and the same circle radii while still acceptable, was 77% and 93% respectively. As is known to experienced shooters, sometimes a higher pattern density (tighter, smaller) is desired, at other times a lower pattern density (wider, larger) is more desirable, depending on a number of factors such as target range, accuracy of aim and number and type of targets.

It is thought that the shot charge and wad structure of the Present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A shot charge and wad structure, comprising:

(a) a 12 gauge plastic shot wad cup having a base portion having an axial thickness in the range of from about 0.50 cm. to about 1.00 cm. and a continuous sidewall portion having a thickness within the range of from about 0.08 cm. to about 0.20 cm. integrally connected to the base portion which together therewith defines a shot pocket open at one end for receiving and supporting a charge of shot pellets;

(b) a charge of 6 to 12 tungsten shot pellets having a diameter within the range of from about 0.60 cm. to about 0.70 cm. contained in the shot pocket; and (c) an insert disk disposed in the shot pocket below the shot charge and having an axial thickness within the range of from about 0.10 cm. to about 0.20 cm and being composed of a material sufficiently hard to prevent any of the pellets in the charge from embedding significantly therein.

2. The shot charge and wad structure of claim 1, wherein the base portion is composed of a plastic material having a tensile strength within the range of from about 4000 psi to about 8500 psi as measured by ASTM Test Method D638 and having an impact notch strength within the range of from about 0.4 foot-pounds/inch up to 4.0 foot-pounds/inch as measured by ASTM Test Method D256A in the bottom corner region of the wad where the base portion and wall portions join.

3. The structure of claim 2, wherein the insert disk has a hardness of at least 70 when measured by the Rockwell B hardness test.

4. The structure of claim 1, wherein the shot pocket is generally circular in transverse cross-section.

5. The structure of claim 1, wherein the shot pocket is generally square in transverse cross-section.

* * * * *